US005381219A

United States Patent [19]

Miskinis et al.

[11] Patent Number: 5,381,219

[45] Date of Patent: Jan. 10, 1995

[54] SIZE DISTRIBUTION OF CARRIER PARTICLES FOR USE IN A MAGNETIC BRUSH

[75] Inventors: Edward T. Miskinis; Orville C. Rodenberg; Bijay S. Saha, all of Rochester, N.Y.

[73] Assignee: Eastman Kodak Company, Rochester, N.Y.

[21] Appl. No.: 970,520

[22] Filed: Nov. 2, 1992

[51] Int. Cl.[6] ..... G03G 21/00

[52] U.S. Cl. ..... 355/305; 430/125

[58] Field of Search ..... 355/305, 306, 251; 430/125, 108

[56] References Cited

U.S. PATENT DOCUMENTS

| | | | |
|---|---|---|---|
| 2,911,330 | 11/1959 | Clark | 134/1 |
| 4,125,667 | 11/1978 | Jones | 428/403 |
| 4,310,611 | 1/1982 | Miskinis | 430/108 X |
| 4,482,621 | 11/1984 | Kashiwagi | 430/107 |
| 4,554,234 | 11/1985 | Imai et al. | 430/122 |
| 4,754,304 | 6/1988 | Ohashi et al. | 355/270 |
| 4,916,492 | 4/1990 | Hoshika et al. | 355/253 |
| 4,972,233 | 11/1990 | Yamazaki et al. | 355/306 |
| 4,978,597 | 12/1990 | Nakahara et al. | 430/122 |
| 5,009,973 | 4/1991 | Yoshida et al. | 430/45 |
| 5,014,089 | 5/1991 | Sakashita et al. | 355/251 |

FOREIGN PATENT DOCUMENTS

| | | | |
|---|---|---|---|
| 58-114073 | 7/1983 | Japan | 355/305 |
| 58-202474 | 11/1983 | Japan | 355/305 |
| 59-223458 | 12/1984 | Japan | 430/108 |
| 2-143286 | 6/1990 | Japan | 355/305 |

*Primary Examiner*—Joan H. Pendegrass
*Attorney, Agent, or Firm*—Norman Rushefsky

[57] ABSTRACT

The present invention relates to carrier particles which are used in image reproduction machines that include a magnetic brush for cleaning an imaging member. These carrier particles are utilized by the magnetic brush to clean the imaging member. The carrier particles include magnetic particles having a particle size distribution ranging from about 150 microns in diameter to about 1 micron in diameter. Preferably at least about 50% by weight of the magnetic particles have a diameter of less than about 45 microns. Preferably the carrier particles have an aspect ratio of about 8 and are made of stainless steel or iron.

16 Claims, 3 Drawing Sheets

SIZE DISTRIBUTION OF CARRIER PARTICLES FOR USE IN A MAGNETIC BRUSH

TECHNICAL FIELD OF THE INVENTION

The present invention relates generally to electrostatographic reproduction apparatus including an imaging member upon which transferable images are developed with two-component developer and, more specifically, to size distributions for magnetic carrier particles which optimize cleaning of the imaging member by a magnetic brush.

BACKGROUND ART

In a typical electrostatographic reproduction apparatus, a photoconductive imaging member has a uniform charge applied to it. The member is then imagewise exposed to light to selectively discharge the member through a grounded conductive layer, leaving behind an electrostatic latent image, corresponding to information to be reproduced, on the photoconductive member. This latent image is developed with toner particles from a two-component developer to form a visible image. The visible image is transferred to a receiver sheet to which the visible image is permanently fixed by fusing it with heat and/or pressure.

To prepare the photoconductive imaging member for the next copying cycle, the member is cleaned to remove debris such as residual toner particles and paper dust, and to cure film damage incurred during the transfer step. Cleaning of the photoconductive member may be performed, for example, with a magnetic brush. Such a magnetic brush includes a core composed of a series of radially mounted, alternating pole magnets. The magnets are surrounded by a cylindrical shell made of a nonmagnetic, conductive material. Relative movement is provided between the core and the shell by rotating the core and/or the shell. Magnetic carrier particles, preferably similar to carrier particles used in the two-component developer, are applied to the surface of the shell. The carrier particles adhere to the shell due to the carrier particles attraction to the magnetic core. In addition, the carrier particles, under the influence of the alternating pole magnetic fields, tumble about the surface of the shell.

The photoconductive member is cleaned by being contacted with the mass of tumbling carrier particles. The carrier particles remove residual toner particles and also abrade the outer surface of the photoconductive member to effect cleaning. The degree of abrasion is important in determining proper preparation of the photoconductive imaging member. If not enough wear of the photoconductive member is accomplished, the photoconductive member will not be effectively cleaned. This will result in image artifacts on subsequent copies created on the electrostatographic reproduction apparatus resulting in poor quality copies. On the other hand, if too much wear is imposed, the photoconductive member's life span will be greatly reduced. This will necessitate changing the photoconductor more frequently, resulting in higher operating costs for the reproduction apparatus.

The above described excessive wear occurs when small sized carrier particles are used to clean the photoconductive imaging member. However, if larger sized particles are used, the photoconductive imaging member becomes scratched and thus damaged. This will result in image artifacts on output copies.

SUMMARY OF THE INVENTION

In view of the foregoing discussion, an object of this invention is to provide carrier particles, having a particular size distribution, which provide optimal cleaning of an imaging member of an electrostatographic reproduction apparatus upon which transferable images are developed from two-component developer.

The carrier particles of the present invention are used in an electrostatographic reproduction machine which includes a magnetic brush for cleaning of the imaging member. The carrier particles, which are made of a magnetic material, are utilized by the magnetic brush to clean the imaging member and/or to develop an image. At least about 50% by weight of the magnetic particles are selected to have a diameter of less than about 45 microns.

The carrier particles preferably have a particle size distribution ranging from about 1 micron in diameter to about 150 microns in diameter.

The invention, and its objects and advantages, will become more apparent in the detailed description of the preferred embodiment presented below.

BRIEF DESCRIPTION OF THE DRAWINGS

In the detailed description of the preferred embodiments of the invention presented below, reference is made to the accompanying drawings, in which.

DETAILED DESCRIPTION OF THE PREFERRED EMBODIMENT

Figure 1:
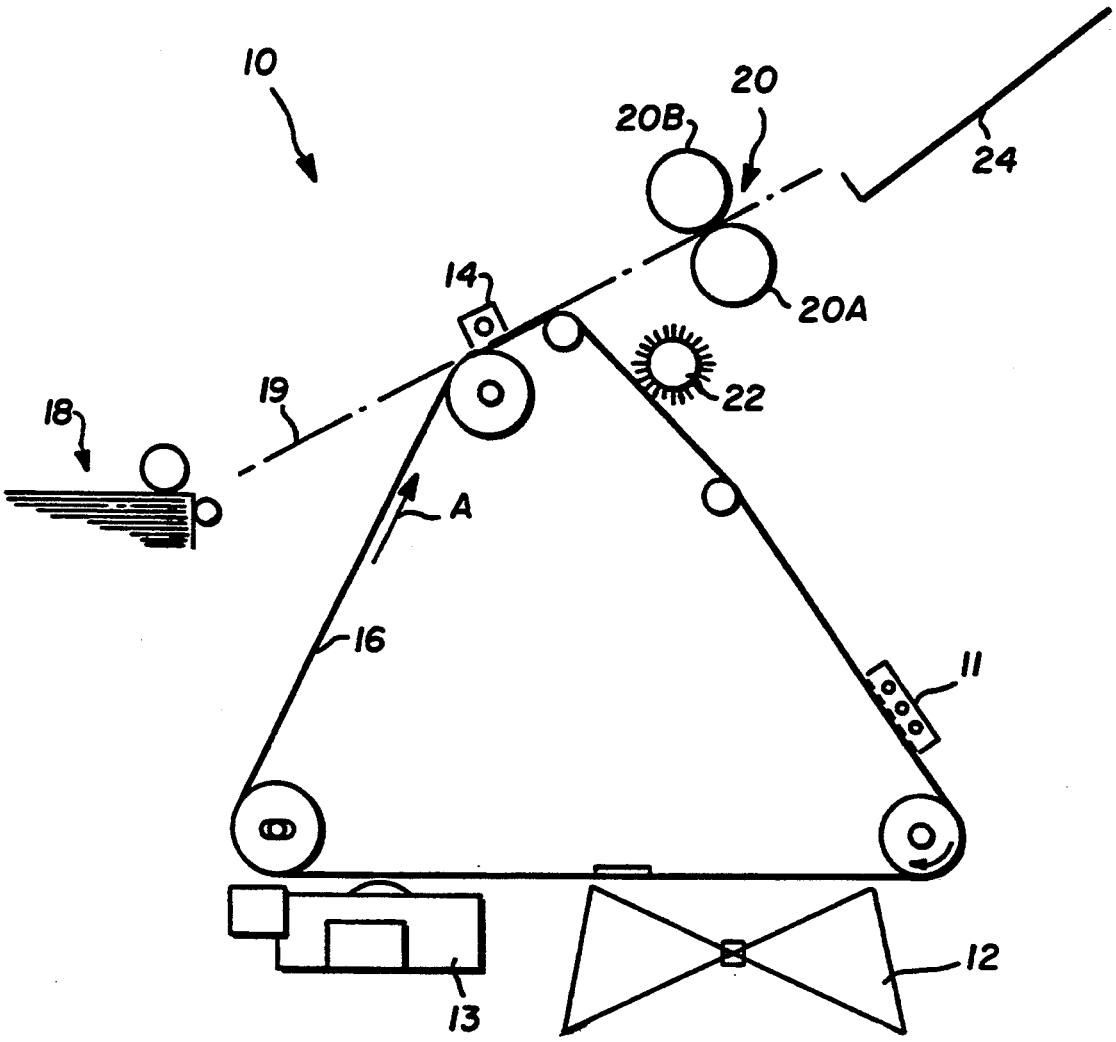
FIG. 1 is a schematic side elevational view of an electrostatographic reproduction apparatus including a magnetic brush cleaning station containing carrier particles of a distribution according to this invention.

The present invention will be described with respect to one typical electrostatographic reproduction apparatus which is designated generally by the reference numeral 10 in FIG. 1, although other reproduction apparatus are suitable for use with this invention. An imaging member represented by an endless web 16, having at least a photoconductive layer and a grounded conductive layer, is transported about a closed loop path in the direction of an arrow A. A corona charger 11 applies a uniform electric charge to the web surface. An exposure station 12 imagewise exposes the web 16 to light in a pattern indicative of an original image to be reproduced. This exposure discharges the surface where light strikes it, leaving behind an electrostatic latent image corresponding to the original image.

A toning station 13, such as a magnetic brush development apparatus, develops the latent image with a two-component developer including pigmented, charged marking particles (commonly referred to as toner) to form a visible image. A receiver sheet, such as a plain piece of bond paper, is fed from a receiver sheet supply 18 along a path 19 and into engagement with web 16. The feed of the receiver sheet is timed such that the receiver sheet overlies the developed visible image. A transfer charger 14 is utilized to transfer the developed visible image from the web to the receiver sheet as the two move in unison past the transfer charger. After transfer, the receiver sheet continues along path 19 to a fusing station 20 which includes a heated fusing roller 20A and a nonheated pressure roller 20B in a nip relation. These rollers apply heat and pressure to permanently fix the toner of the developed visible image to the receiver sheet. Finally, the receiver sheet is deposited in an exit tray 24.

In order to prepare the surface of web 16 for the next copying cycle, a magnetic brush 22 is provided to clean the web surface of debris such as residual toner particles and paper dust, and to remove film damage caused by the transfer process. Magnetic brush 22 is shown in greater detail in FIG. 2. Magnetic carrier particles (preferably similar in nature to carrier particles in the two-component developer) are located on the outer surface of a conductive, nonmagnetic shell 26. The carrier particles remain on the shell due to their attraction to a magnetic core 28 located within shell 26. The attraction is caused by magnetic field forces which emanate from the magnetic core. Chains of carrier particles extent radially away from the shell. The magnetic core is composed of a series of radially mounted, alternating pole magnets. During operation of magnetic brush 22 core 28 remains stationary while shell 26 is rotated.

Figure 2:
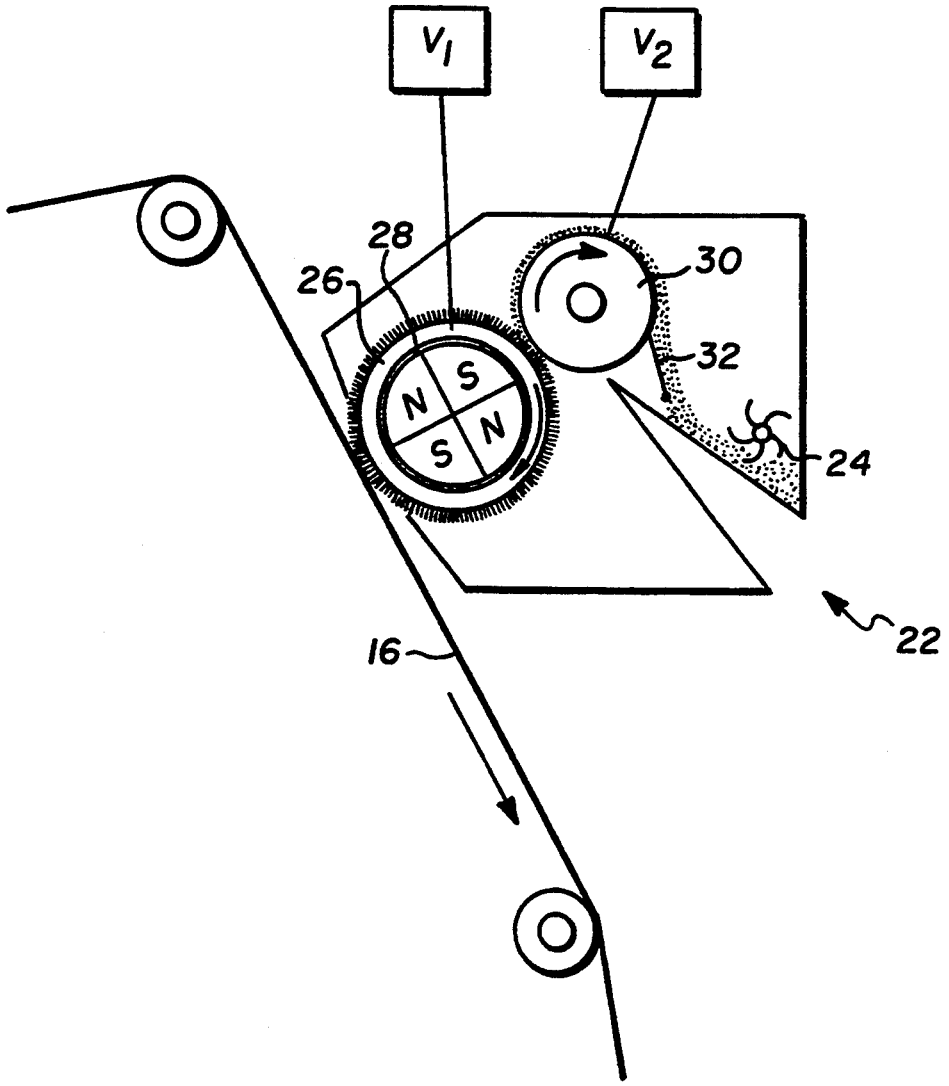
FIG. 2 is a schematic side elevational view of a magnetic brush cleaner, utilized in the reproduction apparatus of FIG. 1, partly in cross-section with portions removed to facilitate viewing.

Cleaning of the photoconductive surface is accomplished by contacting the surface with the chains of carrier particles. The chains of carrier particles are transported by shell 26 in a direction preferably opposite to the direction of travel of web 16 (controlled by direction of rotation of the core and/or shell of the magnetic brush). As the chains of carrier particles contact the web surface, they remove debris from the surface and slowly abrade the outer surface of the web. An electrical bias (for example of about 100 volts in the preferred embodiment) of a polarity opposite to the charge on the toner particles is applied to shell 26 by a voltage supply V1. This electrical bias assists in attracting debris away from the web surface toward shell 26. A debris removal roller 30 has an electrical bias applied to it by a voltage supply V2. This bias is of the same polarity as the bias applied to shell 26 and has a greater magnitude than the bias applied to shell 26 (about 260 volts in the preferred embodiment). This causes the debris on shell 26 to transfer from the shell to roller 30. Debris on roller 30 is stripped therefrom by a skive 32. A rotating auger 24 transports the debris out of the magnetic brush in a direction perpendicular to the surface of the paper on which FIG. 2 is drawn.

Figure 3:
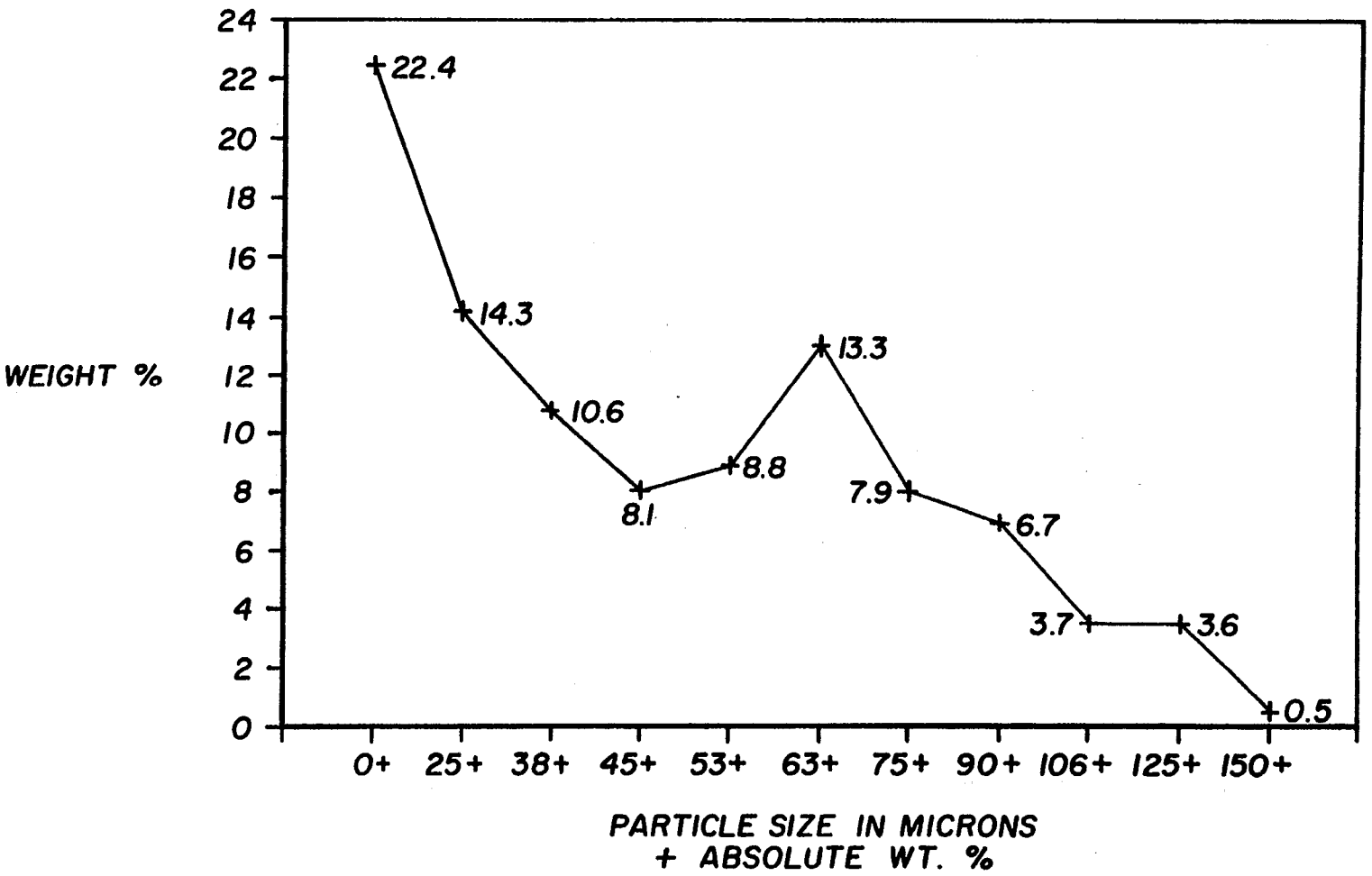
FIG. 3 is a graph of a preferred particle size distribution for carrier particles according to this invention in which absolute weight percent of carrier particles is plotted against particle size.

The particle size distribution for the carrier particles used in magnetic brush 22 is very important. If the particles are too small, the photoconductive layer will be worn away too quickly. On the other hand, if the carrier particles are too large, the photoconductive layer will be scratched. By blending a small portion of larger particles with the small particles, a controlled wear of the photoconductive layer is achieved without scratching the photoconductive layer. FIG. 3 shows a plot of carrier particle size (diameter) in microns against the absolute weight percent of the carrier particles. From the graph of FIG. 3 it can be seen that with the desired particle distribution according to this invention, at least about 50% by weight of the particles have a particle size of less than about 45 microns. Preferably, the carrier particles have a particle size distribution ranging from about 1–150 microns.

The performance of the carrier particles may be further improved by controlling the shape of the particles. By flattening out a rounded particle to a flake like particle, more surface area is provided to the particle. This provides a softer magnetic nap which will more gently abrade web 16 without scratching the web. Preferably, these flake like particles have an average aspect ratio of about 8 with the aspect ratio equalling the average surface area of a particle divided by the particle's average cross-sectional area. The aspect ratio of carrier particles can be determined by mounting the particles on a glass slide and taking optical micrographs under low magnification. Because the particles are asymmetric (in terms of their physical dimensions), an optical micrograph yields only the size and topography of the facing portion of the particle and not the cross-sectional area. To image the cross-section, the particles are frozen in epoxy with their cross-sectional side up and left for about 12 hours to settle. The frozen samples are then polished following standard polishing techniques by using 5 $\mu$m alumina powder. The optical micrographs reveal the size and topography of the crosssection.

The invention has been described in detail with particular reference to preferred embodiments thereof, but it will be understood that variations and modifications can be effected within the spirit and scope of the invention. Although the invention has been described in terms of an electrostatographic reproduction apparatus, it can be used in other imaging reproduction machines in which carrier particles are used to clean an imaging member. Further, the carrier particles of the present invention can be utilized in a two-component developer, which includes toner particles, for developing images with a magnetic brush.

What is claimed is:

1. For use in an image reproduction machine which includes a magnetic cleaning brush and an imaging member, carrier particles which are utilized by the magnetic cleaning brush to clean the imaging member, said carrier particles comprising:

magnetic particles wherein at least about 50% by weight of said magnetic particles have a diameter of less than about 45 microns and wherein said magnetic particles have a particle size distribution ranging from about 1 micron in diameter to about 150 microns in diameter.

2. Carrier particles as defined in claim 1 wherein said magnetic particles are comprised of stainless steel.

3. Carrier particles as defined in claim 1 wherein said magnetic particles have an aspect ratio of about 8.

4. Carrier particles as defined in claim 3 wherein said magnetic particles are comprised of stainless steel.

5. Carrier particles as defined in claim 1 wherein said magnetic particles are comprised of iron.

6. Carrier particles as defined in claim 5 wherein said magnetic particles have an aspect ratio of about 8.

7. The carrier particles of claim 1 in combination with a magnetic cleaning brush.

8. A magnetic brush for utilization in an image reproduction machine, comprising:

a core including a series of alternating pole magnets;

a conductive, nonmagnetic shell surrounding the core and having an outer surface;

a supply of magnetic carder particles wherein at least about 50% by weight of said magnetic carrier particles have a diameter of less than about 45 microns and wherein said magnetic carrier particles have a particle size distribution ranging from about 1 micron in diameter to about 150 microns in diameter;

means for applying said carrier particles to said outer surface of said shell; and means for applying an electrical voltage to said shell.

9. The magnetic brush as defined in claim 8 wherein said carrier particles are comprised of stainless steel.

10. The magnetic brush as defined in claim 8 wherein said carrier particles have an aspect ratio of about 8.

11. The magnetic brush as defined in claim 10 wherein said carrier particles are comprised of stainless steel.

12. The magnetic brush as defined in claim 8 wherein said carrier particles are comprised of iron.

13. The magnetic brush as defined in claim 12 wherein said carrier particles have an aspect ratio of about 8.

14. The magnetic brush as defined in claim 8 and wherein said brush is a cleaning brush.

15. For use in an image reproduction machine which includes a magnetic cleaning brush and an imaging member, carder particles which are utilized by the magnetic cleaning brush to clean the imaging member, said carrier particles comprising:

magnetic particles wherein at least about 50% by weight of said magnetic particles have a diameter of less than about 45 microns and wherein there is a substantial amount of particles larger than 45 microns and the magnetic particles are generally flake-like particles having an aspect ratio of about 8 with the aspect ratio representing a ratio of an average surface area of a particle divided by the particle's average cross-sectional area.

16. The carrier particles of claim 15 in combination with a magnetic cleaning brush.

* * * * *